US010938131B1

(12) United States Patent
Gisoldi

(10) Patent No.: US 10,938,131 B1
(45) Date of Patent: Mar. 2, 2021

(54) INSERT FOR A BATTERY TERMINAL FOR INCREASED RETENTION

(71) Applicant: TYCO ELECTRONICS BRASIL LTDA., Braganca Paulista (BR)

(72) Inventor: Mauricio Gisoldi, Braganca Paulista (BR)

(73) Assignee: Tyco Electronics Brasil LTD A

( * ) Notice: Subject to any disclaimer, the term of this patent is extended or adjusted under 35 U.S.C. 154(b) by 0 days.

(21) Appl. No.: 16/582,018

(22) Filed: Sep. 25, 2019

(51) Int. Cl.
*H01R 11/28* (2006.01)
*H01R 4/48* (2006.01)

(52) U.S. Cl.
CPC ..... *H01R 11/286* (2013.01); *H01R 4/48* (2013.01); *H01R 11/282* (2013.01)

(58) Field of Classification Search
CPC .... H01R 13/187; H01R 13/20; H01R 13/111; H01R 13/113; H01R 11/286; H01R 11/282; H01R 4/48
USPC ..... 439/760–764, 843–846
See application file for complete search history.

(56) References Cited

U.S. PATENT DOCUMENTS 2,384,211 A * 9/1945 Sutherland ..... H01R 11/286 439/766
2,434,398 A * 1/1948 Daellenbach ..... H01R 11/286 439/759
3,008,114 A * 11/1961 Adkins ..... H01R 11/286 439/224
3,980,387 A * 9/1976 Neidecker ..... H01M 2/06 439/750
4,354,726 A * 10/1982 Kato ..... H01R 11/286 439/763
5,879,202 A * 3/1999 Zhao ..... H01R 11/283 439/761
5,915,758 A * 6/1999 Alfiero ..... H01M 2/305 29/854
6,287,155 B1 * 9/2001 Yakovich ..... H01R 11/282 439/754
6,561,855 B1 * 5/2003 Cret ..... H01R 11/283 439/762
2008/0274639 A1 * 11/2008 Sikora ..... H01R 11/286 439/522
2015/0357731 A1 * 12/2015 Tanigawa ..... H01M 2/305 439/762

* cited by examiner

*Primary Examiner* — Gary F Paumen

(57) ABSTRACT

A connector for terminating to a battery terminal post. The connector includes a post-engaging portion which has an opening for receiving the battery terminal post therein. The post-engaging portion is movable between an open position and a secured position. A retention insert is provided in the opening of the post-engaging portion. The insert has resiliently deformable projections which extend into the opening. With the battery terminal post inserted into the opening and the post-engaging portion moved to the secured position, the resiliently deformable projections of the insert engage and retain the battery terminal post in the opening to prevent unwanted movement of the connector relative to the battery terminal post.

16 Claims, 3 Drawing Sheets

INSERT FOR A BATTERY TERMINAL FOR INCREASED RETENTION

FIELD OF THE INVENTION

The present invention is directed a battery terminal for terminating to a battery terminal post. In particular, the invention is directed to an insert for the battery terminal with increases the retention between the battery terminal and the battery terminal post

BACKGROUND OF THE INVENTION

Batteries are used as a mobile source of power for a wide variety of devices and equipment. Batteries are also used in many vehicles and other types of equipment to ignite a combustion engine. For those devices in which a battery is used, the terminals of the battery are electrically connected to the electrical system in that device equipment or vehicle. Thus, battery terminal connectors are required for connecting the battery to an electrical system in, for example, an automobile, watercraft, recreational vehicle, tractor, truck, lawn mower, etc.

Periodically, it is necessary for a battery to be replaced. This may occur because the battery loses the capacity to function properly by being depleted of its charge. In some cases, such as in an automobile, the battery is normally recharged during operation of the device that battery serves. However, even where the battery is rechargeable, it will eventually, through wear and tear, become unable to accept and maintain a charge and will have to be replaced. Additionally, when work is being done on or near the electrical system of, for example, a vehicle, it may be a wise precaution to disconnect the battery from the electrical system to prevent the possibility of being shocked or having an electrical surge damage tools or the equipment being serviced.

Battery cables are typically attached to the terminal post of a battery using a clamp type battery connector. These connectors include a conductor terminating portion for accommodating a stripped end of the battery cable, a post-engaging portion for engaging the battery terminal post and a clamping portion which is tightened around the terminal post to provide secure connection thereto. The clamping portion of most battery connectors includes a pair of arms defining a circular portion therebetween which may be positioned around the battery terminal post. The ends of the arms may be brought together with a fastening device such as a nut and bolt or a camming member to tightly secure the arms about the battery post.

However, even when the clamping portion is tightened, such battery terminals may move or slide relative to the terminal post in environments in which vibration and the like occurs, for example in vehicle engines. This is particularly true for terminal posts which have a tapered profile. As both the inside surface of the post-engaging portion and the outside surface of the terminal post are relative smooth, relative movement over time can occur. In order to prevent this movement, various battery terminals have included ridges or dimples on the inside surface of the post-engaging portion. The ridges or dimples are adapted to penetrate the terminal post when the clamping portion is clamped thereto. While this provides additional retention, the penetration of the terminal post by the ridges or dimples damages the terminal post during the lifetime of the battery.

It would, therefore, be beneficial to provide a battery terminal which provides increase retention without damaging the terminal post or the battery. It would also be beneficial to provide a battery terminal which is cost effective to manufacture.

SUMMARY OF THE INVENTION

An embodiment is directed to a connector for terminating to a battery terminal post. The connector includes a post-engaging portion which has an opening for receiving the battery terminal post therein. The post-engaging portion is movable between an open position and a secured position. A retention insert is provided in the opening of the post-engaging portion. The insert has resiliently deformable projections which extend into the opening. With the battery terminal post inserted into the opening and the post-engaging portion moved to the secured position, the resiliently deformable projections of the insert engage and retain the battery terminal post in the opening to prevent unwanted movement of the connector relative to the battery terminal post.

An embodiment is directed to a connector for terminating to a battery terminal post. The connector includes a post-engaging portion which has an opening for receiving the battery terminal post therein. The post-engaging portion is movable between an open position and a secured position. An insert is provided in the opening of the post-engaging portion. The insert has resiliently deformable projections which extend into the opening. The projections have terminal post engagement surfaces and fixed ends which are opposed to the terminal post engagement surfaces. The projections pivot about the fixed ends and are resiliently deformed toward a side wall of the insert when the battery terminal post is inserted into the aperture. With the battery terminal post inserted into the opening and the post-engaging portion moved to the secured position, the resiliently deformable projections of the insert engage and retain the battery terminal post in the opening to prevent unwanted movement of the connector relative to the battery terminal post.

An embodiment is directed to a connector for terminating to a battery terminal post. The connector includes a post-engaging portion, a clamping portion and a conductor termination portion. The post-engaging portion has an opening for receiving the battery terminal post therein. The post-engaging portion is movable between an open position and a secured position. An insert is provided in the opening of the post-engaging portion. The insert has resiliently deformable projections which extend into the opening. The projections have terminal post engagement surfaces and fixed ends which are opposed to the terminal post engagement surfaces. The projections pivot about the fixed ends and are resiliently deformed toward a side wall of the insert when the battery terminal post is inserted into the aperture. The clamping portion includes a pair of spaced apart outwardly extending movable clamping arms, with the clamping arms separated by a slot. The conductor termination portion extends from the post-engaging portion in a direction away from the clamping portion. With the battery terminal post inserted into the opening and the post-engaging portion moved to the secured position, the resiliently deformable projections of the insert engage and retain the battery terminal post in the opening to prevent unwanted movement of the connector relative to the battery terminal post.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
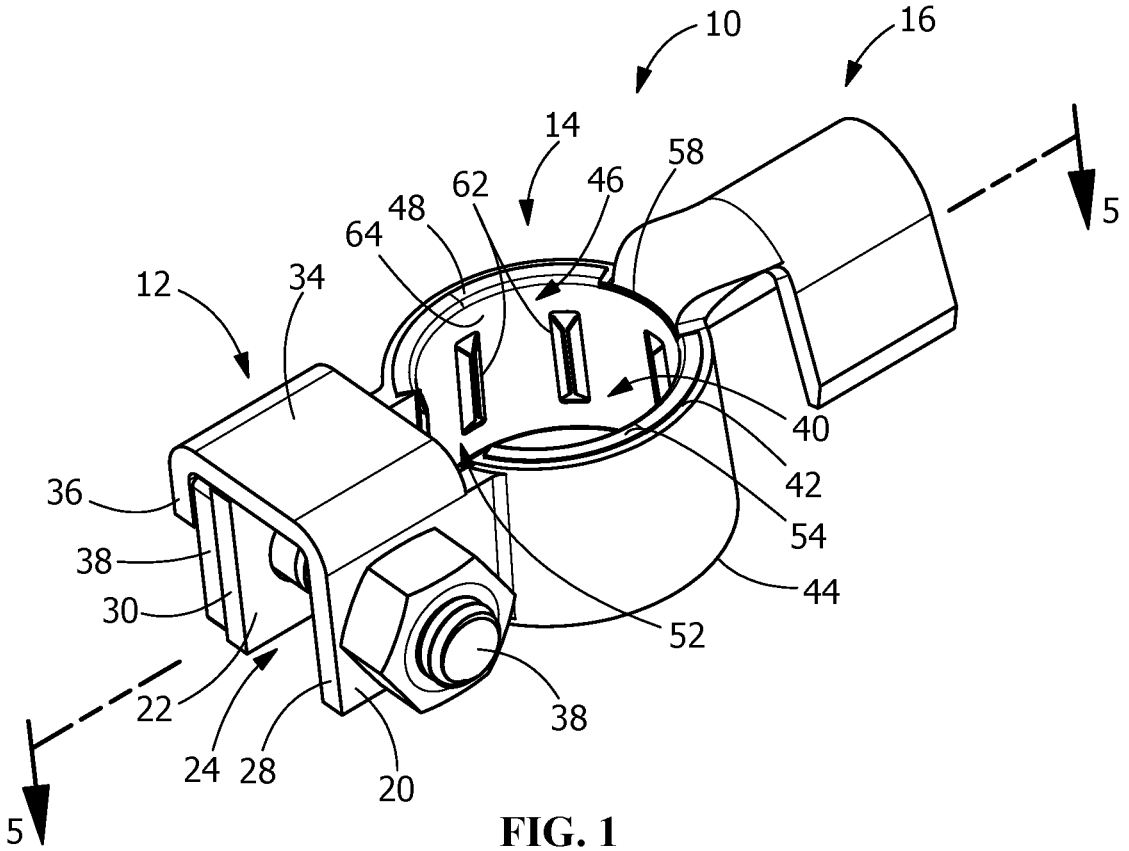
FIG. 1 is a top perspective view of an illustrative embodiment of a battery terminal which includes a retention insert according the present invention.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise.

Moreover, the features and benefits of the invention are illustrated by reference to the preferred embodiments. Accordingly, the invention expressly should not be limited to such embodiments illustrating some possible non-limiting combination of features that may exist alone or in other combinations of features, the scope of the invention being defined by the claims appended hereto.

Figure 2:
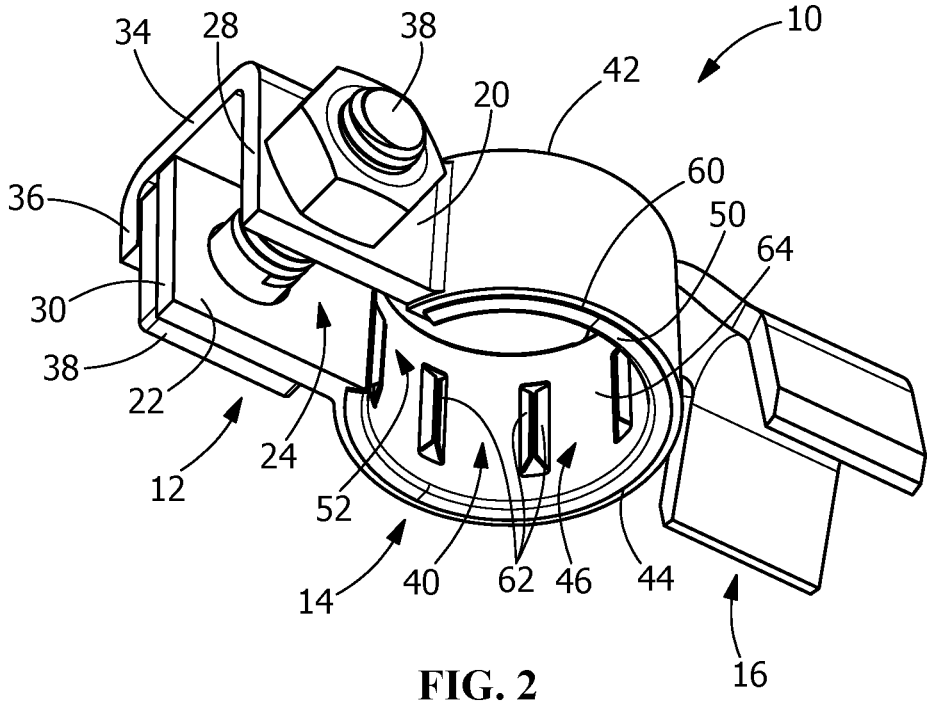
FIG. 2 is a bottom perspective view of the battery terminal of FIG. 1.

Referring to FIGS. 1 and 2, an illustrative embodiment of a battery terminal connector 10 of the present invention is shown. The connector 10 includes a clamping portion 12, a post-engaging portion 14 and a conductor termination portion 16.

Figure 6:
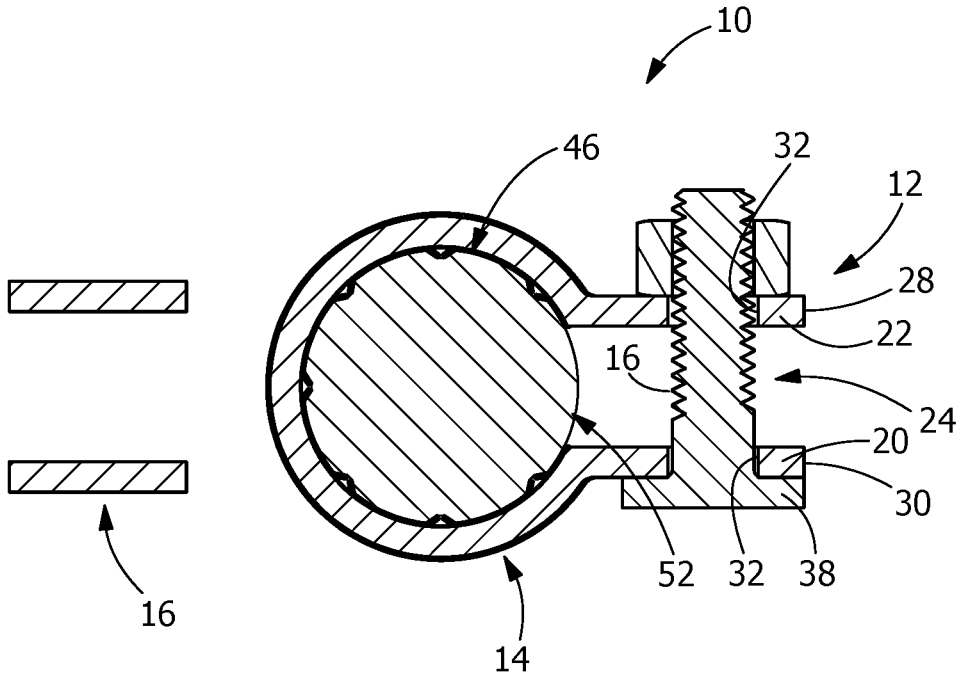
FIG. 6 is a cross-sectional view similar to that of FIG. 5, showing the battery terminal inserted onto a battery terminal post and secured thereto.

The clamping portion 12 extends from the post-engaging portion 14 in a direction away from the conductor termination portion 16. The clamping portion 12 includes a pair of spaced apart outwardly extending movable clamping arms 20, 22 which cooperate with the post-engaging portion 14 to provide for clamping engagement about the post 18 (FIG. 6).

Figure 5:
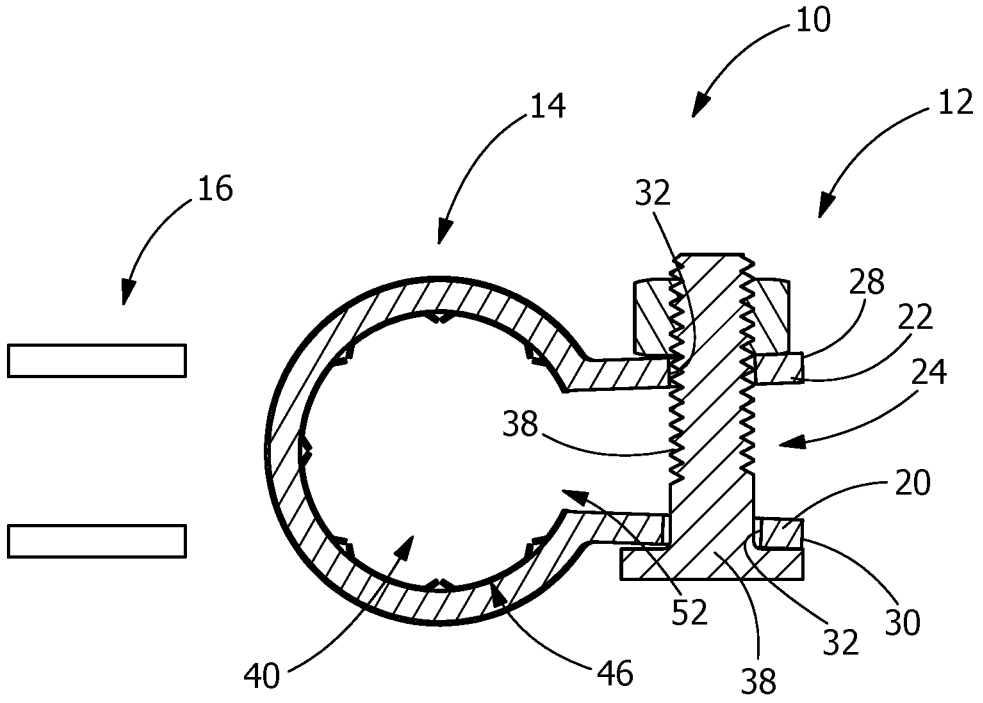
FIG. 5 is a cross-sectional view of the battery terminal taken along line 5-5 of FIG. 1.

The clamping arms 20, 22 are separated by a slot 24. The width of the slot 24 may vary depending upon whether the connector 10 is in a secured, clamped or closed position, as shown in FIG. 5 or an unclamped or open position, as shown in FIG. 6.

In the illustrative embodiment shown, the clamping arms 20, 22 are generally rectangular with outer ends 28, 30. Mounting openings 32 extend through the clamping arms 20, 22 proximate the outer end 28, 30. The clamping arm 20 has a securing projection 34 which extends from a top or first edge of the clamping arm 20. The securing projection 34 extends in a plane which is essentially perpendicular to the plane of the clamping arm 20 and the clamping arm 22. The securing projection 34 extends beyond the clamping arm 22. A mounting projection 36 is provided at the end of securing projection 34. The mounting projection 36 is perpendicular to the securing projection 34 and cooperates with and retains tightening hardware 38 in position. Tightening hardware 38 is provided in the mounting opening 32. In the illustrative embodiment shown, the tightening hardware 38 is a bolt and nut, with the head of the bolt cooperating with the mounting projection 36. However, other types of tightening hardware may be used.

The conductor termination portion 16 extends from the post-engaging portion 14 in a direction away from the clamping portion 12. The conductor termination portion 16 is configured to terminate at a stripped end of an electrical cable, such as a battery cable (not shown). Alternatively, other configurations of the conductor termination portion 16 may be used without departing from the scope of the invention.

The post-engaging portion 14 includes an opening or aperture 40 extending therethrough which is designed for accommodation over the upstanding battery terminal post 18 of a battery (not shown). The aperture 40 forms nearly a full circle to encompass the post 18. The slot 24 extends into the aperture 40. The opening 40 of the post-engaging portion 14 extends from a top or first surface 42 to a bottom or second surface 44.

Figure 3:
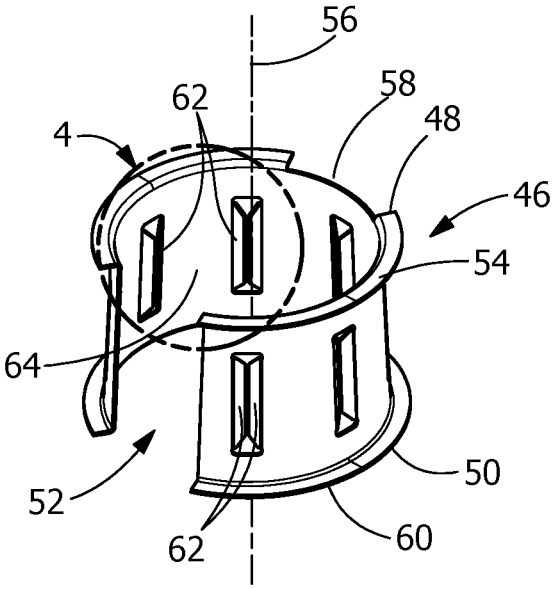
FIG. 3 is a perspective view of the retention insert of the battery terminal of FIG. 1.

A retention insert 46 is provided in the aperture 40. As best shown in FIG. 3, the insert 46 has a cylindrical configuration with an insert top or first surface 48 and an oppositely facing insert bottom or second surface 50. The insert 46 may be made from any conductive material which has the elastic characteristics required. Such material includes, but is not limited to, copper or copper alloys. In the illustrative embodiment shown, the inserts 46 are stamped and formed from sheet material. However, the insert 46 may be manufactured using other known manufacturing processes.

In various embodiments, the insert 46 may be tapered such that the diameter of the insert 46 at the first surface 48 is smaller than the diameter of the insert 46 at the second surface 50. In the illustrative embodiment shown, the insert has a slot 52 provided therein. The slot 52 corresponds in size and positioning to the slot 24 which extends into the aperture 40. In other embodiments, the insert 46 may not have a slot.

A first lip or circumferentially extending projection 54 extends from the first surface 48 of the insert 46. The lip 54 extends in a plane which is approximately perpendicular to a longitudinal axis 56 of the insert 46. The lip 54 has a gap 58 to accommodate the positioning of the conductor termination portion 16. A second lip or ridge 60 extends from the second surface 50 of the insert 46. The lip 60 extends in a plane which is approximately perpendicular to the longitudinal axis 56 of the insert 46 and which is parallel to the plane of the lip 54.

Figure 4:
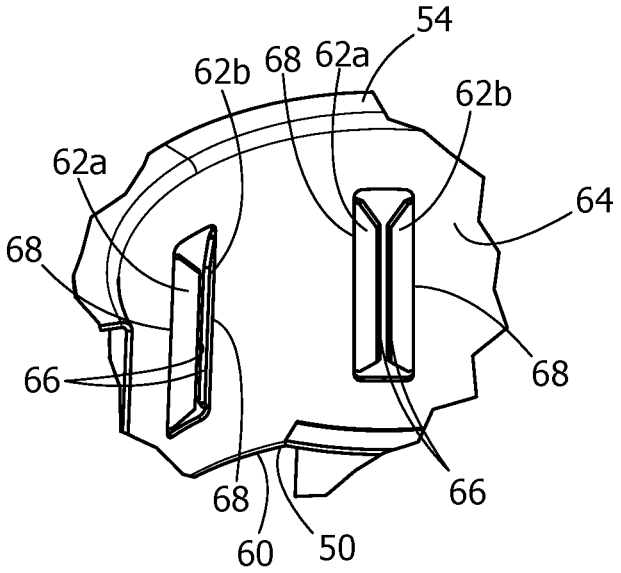
FIG. 4 is an enlarged view of several projections of the retention insert of FIG. 3.

Projections 62 extend inward from the side wall 64 of the insert 46. In the illustrative embodiment shown, the projections 62 are stamped and formed about the side wall 64. Each projection 62 is spaced apart from adjacent projections 62. The projections 62 are elongated members which extend in a direction which is essentially parallel to the longitudinal axis 56 of the insert 46. In an optional embodiment, the projections 62 extend in a direction which are not parallel to the longitudinal axis 56 and/or which are not parallel to each other. As shown in FIG. 4, each of the projections 62 have a terminal post engagement surface 66. In the illustrative embodiment shown, the projections 62 are arranged in pairs with the terminal post engagement surface 66 of one projection 62*a* of the pair of projections 62 provided adjacent the terminal post engagement surface 66 of the second projection 62*b* of the pair of projections 62.

The projections 62 have fixed ends 68 which are opposed to the terminal post engagement surfaces 66. Accordingly, the projections 62 act as spring members which pivot about the fixed ends 68 and are resiliently deformed toward the side wall 64 when the terminal post 18 is inserted into the aperture 40.

Once formed, the insert 46 is positioned in the aperture 40. In the illustrative embodiment, the insert 46 is resiliently compressed to fit into the aperture 40. Once inserted, the insert 46 is allowed to return toward its unstressed position, causing the insert 46 to be placed in mechanical and electrical engagement with the wall of the aperture 40. The insert 46 is retained in position in the aperture 40 by the engagement of the first lip 54 of the insert 46 with the first surface 42 of the post-engaging portion 14 and the engagement of the second lip 60 with the second surface 44 of the post-engaging portion 14.

With the connector 10 fully assembled, the connector 10 is moved into engagement with the terminal post 18 and the terminal post 18 is inserted into the aperture 40 of the post-engaging portion 14. During insertion, the aperture 40 is maintained in the unclamped or open position, as shown in FIG. 5.

With the terminal post 18 properly positioned in the aperture 40, the tightening hardware 38 is tightened, causing the clamping arms 20, 22 to move together, which in turn causes the aperture to move from the open position to the secured or closed position, as shown in FIG. 6. In this position, the terminal post 18 engages the projections 62, forcing the projections 62 to resiliently deform toward the side wall 64. As the projections 62 move toward the side wall 64, the terminal post engagement surfaces 66 of adjacent projections, such as 62*a* and 62*b* also move closer toward each other. In an embodiment, the terminal post engagement surfaces 66 of adjacent projections, such as 62*a* and 62*b* make contact with each other. The resilient movement of the projections 62 toward the side wall 64 causes the projections 62 to exert forces on the terminal post 18. The forces provide a secure clamping or retaining engagement about the post 18. The use of the projections 62 creates a controlled, specific and repeatable force which in turn provides a controlled, specific and repeatable mechanical and electrical connection between the connector 10 and the terminal post 18, without causing damage to the terminal post 18. The retention forces exerted by the projections 62 increase the retention force of the connector 10 and provide sufficient retention force to prevent the unwanted movement of the connector relative to the terminal post 18 even if environments where the terminal post 18 and the connector 10 are subjected to harsh vibrations and the like.

The connector 10 of the present invention may be sized to accommodate different sized terminal posts 18. For example, the positive terminal may have a different diameter from the negative battery terminal. The connector 10 and the insert 46 can be scaled or dimensioned to accommodate either the positive or negative terminal posts. In these instances, the connector of the present invention may also be color coded to indicate which size and which terminal is to be used with each connector.

While the invention has been described with reference to a preferred embodiment, it will be understood by those skilled in the art that various changes may be made and equivalents may be substituted for elements thereof without departing from the spirit and scope of the invention as defined in the accompanying claims. One skilled in the art will appreciate that the invention may be used with many modifications of structure, arrangement, proportions, sizes, materials and components and otherwise used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

The invention claimed is:

1. A connector for terminating to a battery terminal post, the connector comprising:

a post-engaging portion having an opening for receiving the battery terminal post therein, the post-engaging portion movable between an open position and a secured position;

a retention insert provided in the opening of the post-engaging portion, the insert having resiliently deformable projections which extend into the opening, the retention insert having a cylindrical configuration with an insert top surface and an oppositely facing insert bottom surface, a first lip extending from the insert top surface, the first lip extending in a plane which is approximately perpendicular to a longitudinal axis of the retention insert, a second lip extending from the insert bottom surface, the second lip extending in a plane which is approximately perpendicular to the longitudinal axis of the retention insert;

wherein with the battery terminal post inserted into the opening and the post-engaging portion moved to the secured position, the resiliently deformable projections of the retention insert engage and retain the battery terminal post in the opening to prevent unwanted movement of the connector relative to the battery terminal post.

2. The connector as recited in claim 1, wherein the opening extends from a first surface of the post-engaging portion to a second surface of the post-engaging portion.

3. The connector as recited in claim 2, wherein the first lip of the insert engages the first surface of the post-engaging portion and the second lip of the insert engages the second surface of the post-engaging portion to retain the insert in position in the opening of the post-engaging portion.

4. The connector as recited in claim 3, wherein the insert has a slot which extend from the insert top surface to the insert bottom surface.

5. The connector as recited in claim 1, wherein the projections have terminal post engagement surfaces and fixed ends which are opposed to the terminal post engagement surfaces, wherein the projections act as spring members which pivot about the fixed ends and are resiliently deformed toward a side wall when the battery terminal post is inserted into the aperture.

6. The connector as recited in claim 5, wherein the projections are arranged in pairs with the terminal post engagement surface of one projection of the pair of projections provided adjacent the terminal post engagement surface of a second projection of the pair of projections.

7. The connector as recited in claim 1, wherein the connector has a clamping portion, the clamping portion includes a pair of spaced apart outwardly extending movable clamping arms which cooperate with the post-engaging portion to provide for clamping engagement about the post when the post-engaging portion is in the secured position.

8. The connector as recited in claim 7, wherein the connector has a conductor termination portion, the conductor termination portion extends from the post-engaging portion in a direction away from the clamping portion.

9. The connector as recited in claim 7, wherein the clamping arms are separated by a slot, mounting openings extend through the clamping arms.

10. The connector as recited in claim 7, wherein one clamping arm of the clamping arms has a securing projection which extends from a first edge of the one clamping arm, a mounting projection is provided at the end of the securing projection, the mounting projection cooperates with and retains tightening hardware in position.

11. A connector for terminating to a battery terminal post, the connector comprising:

a post-engaging portion having an opening for receiving the battery terminal post therein, the opening extending from a first surface of the post-engaging portion to a second surface of the post-engaging portion, the post-engaging portion movable between an open position and a secured position;

an insert provided in the opening of the post-engaging portion, the insert having resiliently deformable projections which extend into the opening, the projections have terminal post engagement surfaces and fixed ends which are opposed to the terminal post engagement surfaces, the projections pivot on the fixed ends about an axis which is approximately parallel to a longitudinal axis of the retention insert, the projections are resiliently deformed toward a side wall of the insert when the battery terminal post is inserted into the aperture;

the insert having a cylindrical configuration with an insert first surface and an oppositely facing insert second surface, a first lip extending from the insert first surface, the first lip extending in a plane which is approximately perpendicular to a longitudinal axis of the insert, a second lip extending from the insert second surface, the second lip extending in a plane which is approximately perpendicular to the longitudinal axis of the insert, the first lip of the insert engages the first surface of the post-engaging portion and the second lip of the insert engages the second surface of the post-engaging portion;

wherein with the battery terminal post inserted into the opening and the post-engaging portion moved to the secured position, the resiliently deformable projections of the insert engage and retain the battery terminal post in the opening to prevent unwanted movement of the connector relative to the battery terminal post.

12. The connector as recited in claim 11, wherein the insert has a slot which extends from the insert top surface to the insert bottom surface.

13. The connector as recited in claim 12, wherein the projections are arranged in pairs with the terminal post engagement surface of one projection of the pair of projections provided adjacent the terminal post engagement surface of a second projection of the pair of projections.

14. A connector for terminating to a battery terminal post, the connector comprising:

a post-engaging portion having an opening for receiving the battery terminal post therein, the opening extending from a first surface of the post-engaging portion to a second surface of the post-engaging portion, the post-engaging portion movable between an open position and a secured position;

an insert provided in the opening of the post-engaging portion, the insert having resiliently deformable projections which extend into the opening, the projections have terminal post engagement surfaces and fixed ends which are opposed to the terminal post engagement surfaces, the projections pivot on the fixed ends, the projections are resiliently deformed toward a side wall when the battery terminal post is inserted into the aperture;

the insert having a cylindrical configuration with an insert first surface and an oppositely facing insert second surface, a first lip extending from the insert first surface, the first lip extending in a plane which is approximately perpendicular to a longitudinal axis of the insert, a second lip extending from the insert second surface, the second lip extending in a plane which is approximately perpendicular to the longitudinal axis of the insert, the first lip of the insert engages the first surface of the post-engaging portion and the second lip of the insert engages the second surface of the post-engaging portion to retain the insert in position in the opening of the post-engaging portion;

a clamping portion, the clamping portion includes a pair of spaced apart outwardly extending movable clamping arms, the clamping arms are separated by a slot;

a conductor termination portion, the conductor termination portion extends from the post-engaging portion in a direction away from the clamping portion;

wherein with the battery terminal post inserted into the opening and the post-engaging portion moved to the secured position, the resiliently deformable projections of the insert engage and retain the battery terminal post in the opening to prevent unwanted movement of the connector relative to the battery terminal post.

15. The connector as recited in claim 14, wherein the projections are arranged in pairs with the terminal post engagement surface of one projection of the pair of projections provided adjacent the terminal post engagement surface of a second projection of the pair of projections.

16. The connector as recited in claim 14, wherein one clamping arm of the clamping arms has a securing projection which extends from a first edge of the one clamping arm, a mounting projection is provided at the end of securing projection, the mounting projection cooperates with and retains tightening hardware in position.

* * * * *